US007973731B2

(12) United States Patent
Parsche

(10) Patent No.: US 7,973,731 B2
(45) Date of Patent: Jul. 5, 2011

(54) FOLDED CONICAL ANTENNA AND ASSOCIATED METHODS

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 513 days.

(21) Appl. No.: 12/126,465

(22) Filed: May 23, 2008

(65) Prior Publication Data

US 2009/0289865 A1 Nov. 26, 2009

(51) Int. Cl.
*H01Q 13/00* (2006.01)

(52) U.S. Cl. ..... 343/772; 343/773; 343/774

(58) Field of Classification Search ..... None
See application file for complete search history.

(56) References Cited

U.S. PATENT DOCUMENTS

| | | | | |
|---|---|---|---|---|
| 2,175,252 | A | 10/1939 | Carter | 250/33 |
| 2,283,914 | A | 5/1942 | Carter | 250/33 |
| 2,368,663 | A | 2/1945 | Kandoian | 250/33 |
| 4,423,423 | A | 12/1983 | Bush | 343/803 |
| 4,851,859 | A | 7/1989 | Rappaport | 343/790 |
| 6,429,821 | B1 | 8/2002 | Lewis, Jr. | 343/749 |
| 6,697,031 | B2 * | 2/2004 | Jocher | 343/895 |
| 7,142,166 | B2 | 11/2006 | Martek | 343/773 |
| 7,170,462 | B2 | 1/2007 | Ihara et al. | 343/788 |
| 7,245,263 | B2 * | 7/2007 | Hoshi | 343/772 |
| 7,286,095 | B2 | 10/2007 | Parsche et al. | 343/773 |
| 7,864,127 | B2 * | 1/2011 | Parsche | 343/773 |
| 2005/0168393 | A1 * | 8/2005 | Apostolos | 343/773 |
| 2009/0289866 | A1 * | 11/2009 | Parsche | 343/790 |

FOREIGN PATENT DOCUMENTS

DE 1466400 4/1970

* cited by examiner

*Primary Examiner* — Trinh V Dinh
(74) *Attorney, Agent, or Firm* — Allen, Dyer, Doppelt, Milbrath & Gilchrist, P.A.

(57) ABSTRACT

The conical monopole antenna includes a conical antenna element having an apex and a base, a conductive base member coupled across the base of the conical antenna element and a ground plane antenna element, e.g. a disc antenna element, adjacent the apex of the conical antenna element. A fold conductor is coupled between the conductive base member and the ground plane antenna element. The fold conductor may include at least one impedance element, such as a resistive element or inductive element. An antenna feed structure is coupled to the ground plane and conical antenna elements. The antenna may have reduced gain above a cutoff frequency being traded for low VSWR below the cutoff frequency to get increased usable bandwidth. The folded resistive termination is preferential to driving point attenuation and edge loading, and the conical monopole antenna provides low VSWR at most radio frequencies.

25 Claims, 7 Drawing Sheets

FOLDED CONICAL ANTENNA AND ASSOCIATED METHODS

FIELD OF THE INVENTION

The present invention relates to the field of antennas, and more particularly, this invention relates to low-cost broadband antennas, conical and biconical antennas, folded antennas, omnidirectional antennas, and related methods.

BACKGROUND OF THE INVENTION

Modern communications systems are ever more increasing in bandwidth, causing greater needs for broadband antennas Some may require a decade of bandwidth, e.g. 100-1000 MHz. Various needs (e.g. military needs) may require broadband antennas for low probability of intercept (LPI) transmissions or communications jamming. Jamming systems can use high power levels and the antenna must provide a low voltage standing wave ratio (VSWR) at all times. The bandwidth need may be instantaneous and tuning may not suffice.

In the current physics, instantaneous gain bandwidth is linked to antenna size through a relationship known as Chu's Limit (L. J. Chu, "Physical Limitations of Omni-Directional Antennas", Journal of Applied Physics, Vol. 19, pp 1163-1175 December 1948). Under Chu's Limit, the maximum instantaneous 3 dB gain fractional bandwidth of single tuned antennas may not exceed 200 $(r/\lambda)^3$, where r is the radius of a spherical envelope placed over the antenna for analysis, and $\lambda$ is the wavelength. While antenna instantaneous gain bandwidth is limited, voltage standing wave ratio (VSWR) bandwidth is not. Thus, in some systems it may be necessary to trade antenna gain for increased VSWR bandwidth by introducing losses or resistive loading. Losses can be required when the antenna must operate beyond Chu's Limit, that is, to provide low VSWR at small and inadequate sizes. Without dissipative losses, the single tuned instantaneous 2 to 1 VSWR bandwidth of an antenna cannot exceed 70.7 $(r/\lambda)^3$.

Multiple tuning has been proposed as an approach for extending the instantaneous gain bandwidth of antennas, say with a network external to the antenna, such as impedance compensation circuit. Multiple tuned antennas have polynomial responses and may include rippled passbands like a Chebyshev filter. Although beneficial, multiple tuning cannot be a remedy to all antenna size-bandwidth needs. Wheeler has suggested a $3\pi$ bandwidth enhancement limit for infinite order multiple tuning relative single tuning ("The Wideband Matching Area For A Small Antenna", Harold A. Wheeler, IEEE Transactions on Antennas and Propagation, Vol. AP-31, No. 2, March 1983). Simple antennas may provide a "single tuned" frequency response that is quadratic in nature, The ½ wave thin wire dipole is an example of a simple antenna. It can have a 3 dB gain bandwidth of 13.5 percent and a 2.0 to 1 VSWR bandwidth of only 4.5 percent. This is near 5 percent of Chu's single tuned gain bandwidth limit and it is often not adequate. Broadband dipoles are an alternative to the wire dipole. These preferably utilize cone radiating elements, rather than thin wires, for radial rather than linear current flow. They are well suited for wave expansion over a broad frequency range. Conical antennas, which include a single inverted cone over a ground plane, and biconical antennas, which include a pair of cones oriented with their apexes pointing toward each other are used as broadband antennas for various applications, such as, for example, spectrum surveillance.

A biconical antenna including a top inverted cone, a bottom cone and a feed structure, is disclosed in U.S. Pat. No. 2,175,252 to Carter entitled "Short Wave Antenna". Two cones form a self exciting horn which connects to a coaxial circuit that provides an electrical signal that feeds the antenna. The antenna is symmetric about the cone axis and each of the cones is a full cone, spanning 360 degrees. In FIG. 2 of U.S. Pat. No. 2,175,252 a single cone is excited relative a planar member forming a conical monopole. A biconical antenna having for example, a conical flare angle of $\Pi/2$ radians has essentially a high pass filter response from a lower cut off frequency. Such an antenna provides wide bandwidth, and a response of 10 or more octaves is achieved. Yet, even conical antennas are not without limitation: the VSWR rises rapidly below the lower cutoff frequency. Low pass response antennas are seemingly unknown in the present art, Broadband conical dipoles can include dissimilar half elements, such as the combination of a disc and a cone. A discone antenna is disclosed in U.S. Pat. No. 2,368,663 to Kandoian. The discone antenna includes a conical antenna element and a disc antenna element positioned adjacent the apex of the cone. The transmission feed extends through the interior of the cone and is connected to the disc and cone adjacent the apex thereof. A modern discone for military purposes is the model RF-291-AT001 Omnidirectional Tactical Discone Antenna, by Harris Corporation of Melbourne, Fla. It is designed for operation from 100 to 512 MHz and usable beyond 1000 MHz. It has wire cage elements for lightweight and easy of deployment.

U.S. Pat. No. 7,170,462, to Parsche, describes a system of broadband conical dipole configuration for multiple tuning and enhanced pattern bandwidth. Discone antennas and conical monopoles may be related to other by inversion, e.g. one is simply the other upside down. U.S. Pat. Nos. 4,851,859 and 7,286,095 disclose such antennas formed with connectors at the cone and disc, respectively.

Folding in dipole antennas may be attributed to Carter, in U.S. Pat. No. 2,283,914. The thin wire dipole antenna includes a second wire dipole member connected in parallel to form a "fold". In FIG. 5 of U.S. Pat. No. 2,283,914 the folded dipole member included a resistor for the enhancement of VSWR bandwidth. Without the resistor, bandwidth was not enhanced (relative to an unfolded antenna of the same total envelope) but there were advantages of impedance transformation or otherwise. Resistor "terminated" folded dipoles were employed in World War II. Later, in U.S. Pat. No. 4,423,423 to Bush, a resistive load was described in a folded dipole fold member. Resistively terminated folded wire dipole antennas may have low VSWR but lack sufficient gain away from narrow resonances.

Conventional conical antennas have broad instantaneous bandwidth but rapidly rising VSWR at frequencies below cutoff. To obtain sufficiently low VSWR at low frequencies, they may be too physically large. The large size may cause insufficient pattern beamwidth at the higher frequencies. Accordingly, there is a need for a broadband antenna that provides a low VSWR at many or all radio frequencies, at small size, and that does not suffer from these limitations.

SUMMARY OF THE INVENTION

In view of the foregoing background, it is therefore an object of the present invention to provide an electrically small communication antenna with a broad voltage standing wave ratio (VSWR) bandwidth at most radio frequencies.

This and other objects, features, and advantages in accordance with the present invention are provided by a conical monopole antenna including a conical antenna element having an apex and a base, a conductive base member coupled across the base of the conical antenna element and a ground plane antenna element, e.g. a disc antenna element, adjacent the apex of the conical antenna element. A fold conductor is coupled between the conductive base member and the ground plane antenna element. An antenna feed structure is coupled to the ground plane and conical antenna elements.

The antenna feed structure may include a first electrical conductor coupled to the conical antenna element, and a second electrical conductor coupled to the ground plane antenna element. The fold conductor may comprise at least one impedance element, such as a resistive element or inductive element.

The conical antenna element may include an opening at the apex, and the fold conductor may extend through the opening in the conical antenna element. The conical antenna element defines an interior space, and the fold conductor may extend in the interior space and through the opening adjacent the apex of the conical antenna element. The conical antenna element, the conductive base member and the ground plane antenna element may be formed as a continuous conductive layer or a wire structure.

The approach may be referred to as a terminated discone antenna, or a resistor traded antenna which may include an impedance device such as a resistor and/or inductor placed at an electrical fold between the cone and the ground plane or disc. The fold conductor may be an internal wire providing a folded antenna circuit or folded conical monopole antenna, for example. The approach may include reduced gain above a cutoff frequency being traded for low VSWR below the cutoff frequency to get increased usable bandwidth.

A method aspect of the invention is directed to making a conical monopole antenna including providing a conical antenna element having an apex and a base, coupling a conductive base member across the base of the conical antenna element, and positioning a ground plane antenna element, such as a disc antenna element, adjacent the apex of the conical antenna element. The method includes coupling a fold conductor between the conductive base member and the ground plane antenna element, and coupling an antenna feed structure to the ground plane and conical antenna elements.

Coupling the antenna feed structure may include coupling a first electrical conductor to the conical antenna element, and coupling a second electrical conductor to the ground plane antenna element. Coupling the fold conductor may comprise coupling at least one impedance element, such as a resistor or inductor, between the conductive base member and the ground plane antenna element. The method may include forming an opening in the conical antenna element at or adjacent the apex, and then coupling the fold conductor may include extending the fold conductor through the opening in the conical antenna element. The conical antenna element defines an interior space, and extending the fold conductor may include extending the fold conductor through the interior space and through the opening adjacent the apex of the conical antenna element.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
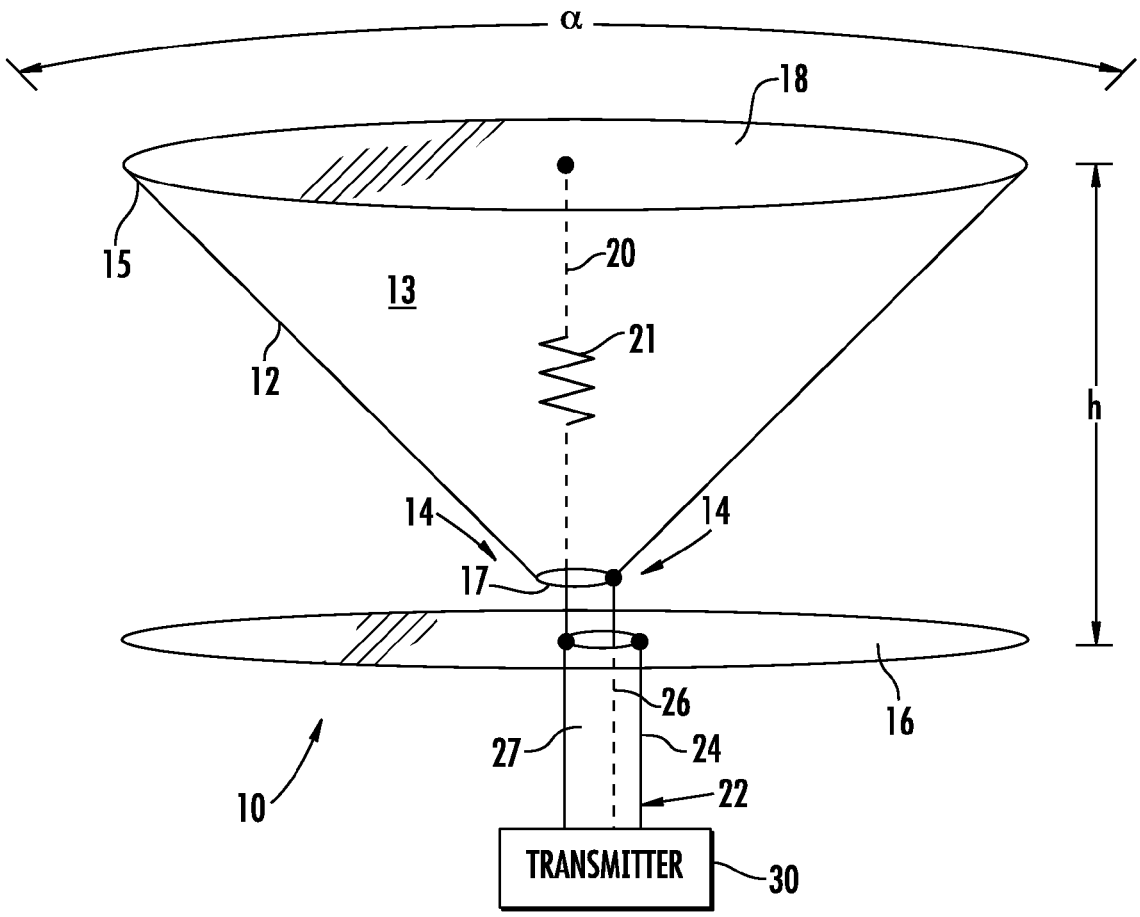
FIG. 1 is a schematic diagram of an exemplary conical monopole antenna according to the present invention.

Referring initially to FIG. 1, a conical monopole antenna 10 in accordance with features of the present invention will be described. The antenna 10 may be specified, for example, as a VHF/UHF omnidirectional conical monopole antenna operating between 100 to 512 MHz, and be usable to 30 MHz or below. The antenna 10 may be referred to as being an electrically small communication antenna with broad VSWR bandwidth. Also, the antenna may be referred to as a terminated conical monopole antenna or a resistor traded antenna which may include an impedance device, such as a resistor and/or inductor, placed at an electrical fold between a cone and a ground plane or disc. The antenna 10 may have reduced gain above a cutoff frequency being traded for low VSWR below the cutoff frequency to get increased usable bandwidth. The term "VSWR bandwidth" generally is defined as that bandwidth over which the antenna system has a VSWR of e.g. 2:1 or less. VSWR may be measured at the input to the transmission line (the output of the transmitter) or at the antenna feedpoint. Herein, VSWR refers to the VSWR measured at the antenna feedpoint.

Figure 3:
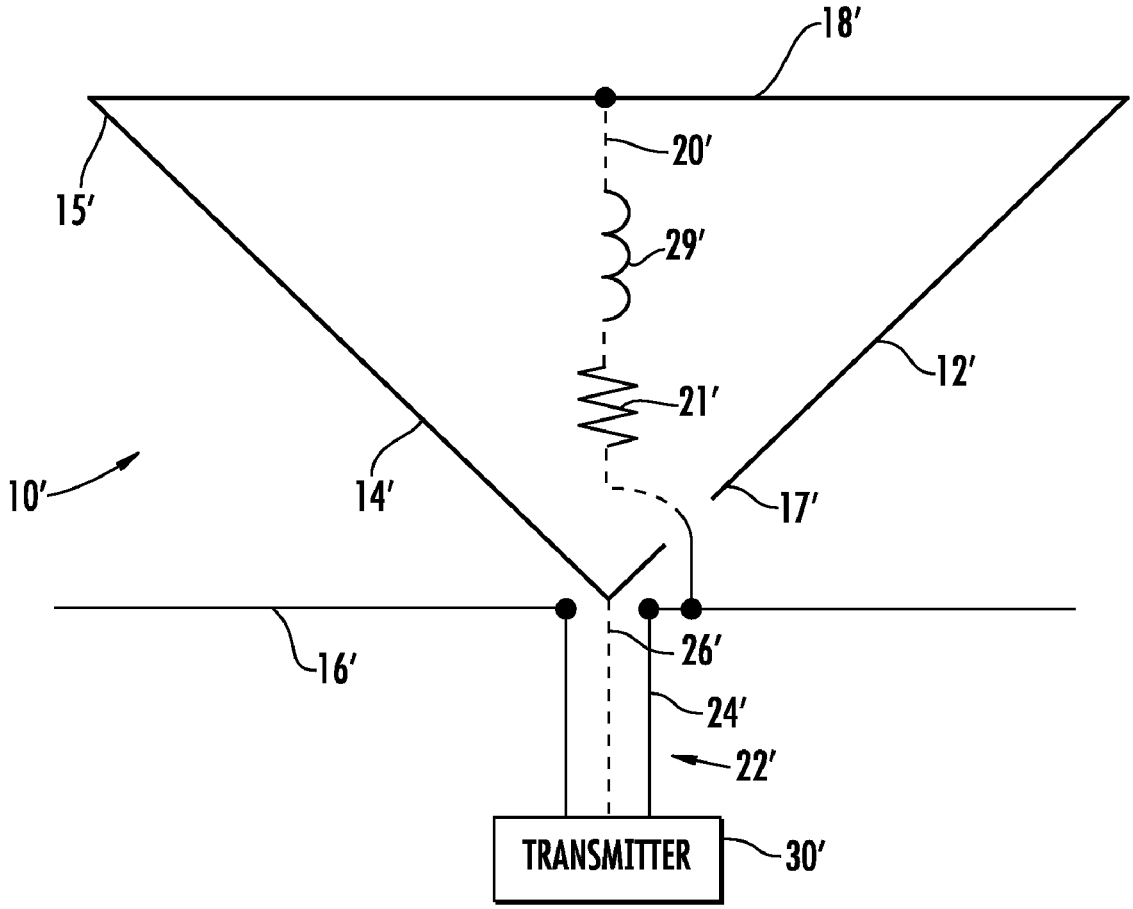
FIG. 3 is a schematic diagram of an exemplary conical monopole antenna according to another embodiment of the present invention

The conical monopole antenna 10 includes a conical antenna element 12 having an apex 14 and a base 15. A conductive base member is 18 configured across the base 15 of the conical antenna element 12, and a ground plane antenna element 16, e.g. a disc antenna element, is adjacent the apex 14 of the conical antenna element 12. A fold conductor 20 is coupled between the conductive base member 18 and the ground plane antenna element 16, and may be internal to the conical antenna element 12. The fold conductor 20 may comprise at least one impedance element 21, such as a resistive element and/or inductive element. The impedance element 21 may be a 50 ohm load resistor, for example. The ground plane antenna element 16 may have a shape other than a disk in other embodiments. The ground plane antenna element may also be defined in situation, e.g. comprising an automobile roof or aircraft fuselage as will be appreciated by those skilled in the art Although not shown, the impedance element 21 may also include a parallel resonant circuit, a series resonant circuit and/or a ladder network of impedance devices, such as resistors, capacitors and inductors. Referring to FIG. 3, an alternative embodiment of an antenna 10' may include a fold conductor 20' having an inductor 29' connected in series with a resistor 21' between the ground plane element 16' and the conductive base member 18'. The conductive base member 18' extends across the base 15' of the conical antenna element 12', and the fold conductor 20' illustratively extends through an opening 17' adjacent the apex 14' of the conical antenna element 12'. Again, an antenna feed structure 22' including outer conductor 24' and inner conductor 26' may be coupled to the antenna 10' at the apex 14' of the conical antenna element 12'.

Referring again to FIG. 1, the conical antenna element 12 may include an opening 17 at or adjacent the apex 14, and the fold conductor 20 may extend through the opening in the conical antenna element. The conical antenna element 12 defines an interior space 13, and the fold conductor 20 illustratively extends in the interior space and through the opening 17 at or adjacent the apex 14 of the conical antenna element 12.

An antenna feed structure 22 is coupled to the conical and disc antenna element 12, 16 and illustratively includes a first conductor 24 coupled to the ground plane antenna element 16, and a second conductor 26 coupled to the conical antenna element 12. Although not depicted, a flanged chassis type coaxial connector may be attached at disc antenna element 16 to assist in the coupling. Feed structure 22 is illustratively coupled to a transmitter 30, but may also be connected to a transceiver and/or other associated antenna feed circuitry as would be appreciated by those skilled in the art.

The first conductor 26 and second conductor 24 define a coaxial transmission feed. Such a coaxial transmission feed includes the first conductor 26 being an inner conductor, a dielectric material 27 surrounding the inner conductor, and the second conductor 24 being an outer conductor surrounding the dielectric material, as would be appreciated by those skilled in the art.

Figure 2:
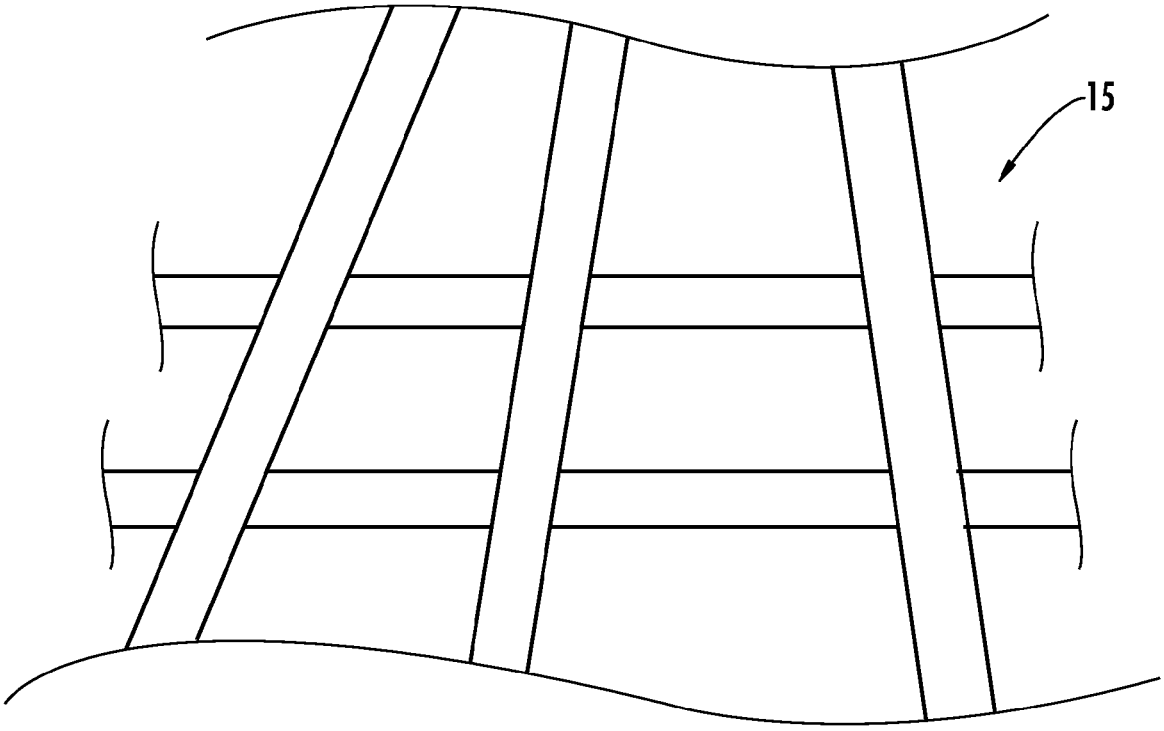
FIG. 2 is an enlarged view of a portion of an exemplary conical monopole antenna according to another embodiment.

The conical antenna element 12, the conductive base member 18 and/or the ground plane antenna element 16 may comprise a continuous conductive layer, as illustrated in FIG. 1, or a wire structure 28 as illustrated in the enlarged portion shown in FIG. 2, as would be appreciated by those skilled in the art.

An example embodiment of the FIG. 1 present invention was prototyped as described in Table 1:

TABLE 1

Example Embodiment Of Present Invention

| Parameter | Value | Units |
|---|---|---|
| Antenna Type | Conical Monopole With Folded Termination | |
| Conical Antenna Element 12 Base Diameter | 0.094 | Meters |
| Conical Antenna Element 12 Height | 0.086 | Meters |
| Conical Antenna Element 12 Flare Angle α | 56 | Degrees |
| Ground Plane Antenna Element 12 Disc Diameter | 0.061 | Meters |
| Conical Antenna Element 12 Material | Rolled Sheet Brass $1.5 \times 10^{-4}$ Thick | Meters |
| Ground Plane Antenna Element 16 Disc Material | Sheet Brass $1.5 \times 10^{-4}$ Thick | Meters |
| Conductive Base Member 18 Material | Sheet Brass $1.5 \times 10^{-4}$ Thick | Meters |
| Fold Conductor 20 Diameter | $6.3 \times 10^{-4}$ (#22 AWG Copper Wire) | Meters |
| Source Impedance | 50 | Ohms |
| Impedance Element 21 Value | 50 Ω Resistive | Ohms |

Figure 4:
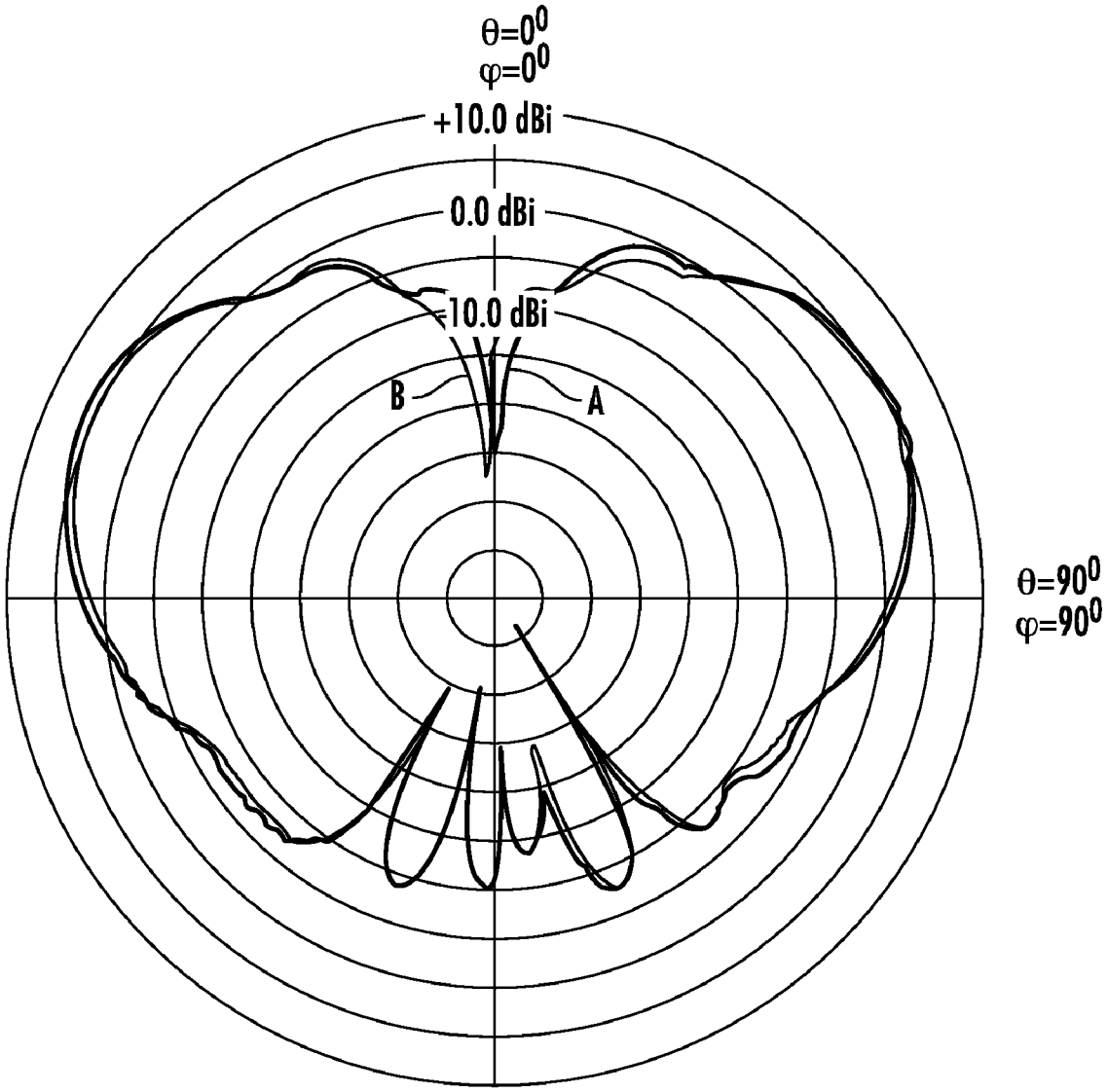
FIG. 4 is a plot of the measured elevation plane radiation patterns of the conical monopole antenna of FIG. 1 compared to a conventional conical monopole antenna.

Performance of the prototype and example embodiment will now be described. FIG. 4 is a plot of the measured elevation plane radiation patterns of the conical monopole antenna 10 of FIG. 1 compared to a conventional conical monopole antenna, measured at 900 MHz. That is, the FIG. 4 radiation patterns are plots of same antenna with and without the folded termination provided by fold conductor 20 and a 50 ohm resistor as impedance element 21. Units are in decibels with respect to isotropic (dBi), and the measured quantity was power and for the $E_\theta$ vertically polarized far fields. As can be appreciated, the radiation pattern shapes with and without the resistor are similar. The azimuth plane pattern cut (not shown) was circular and omnidirectional as can be expected for a body of revolution antenna.

Figure 5:
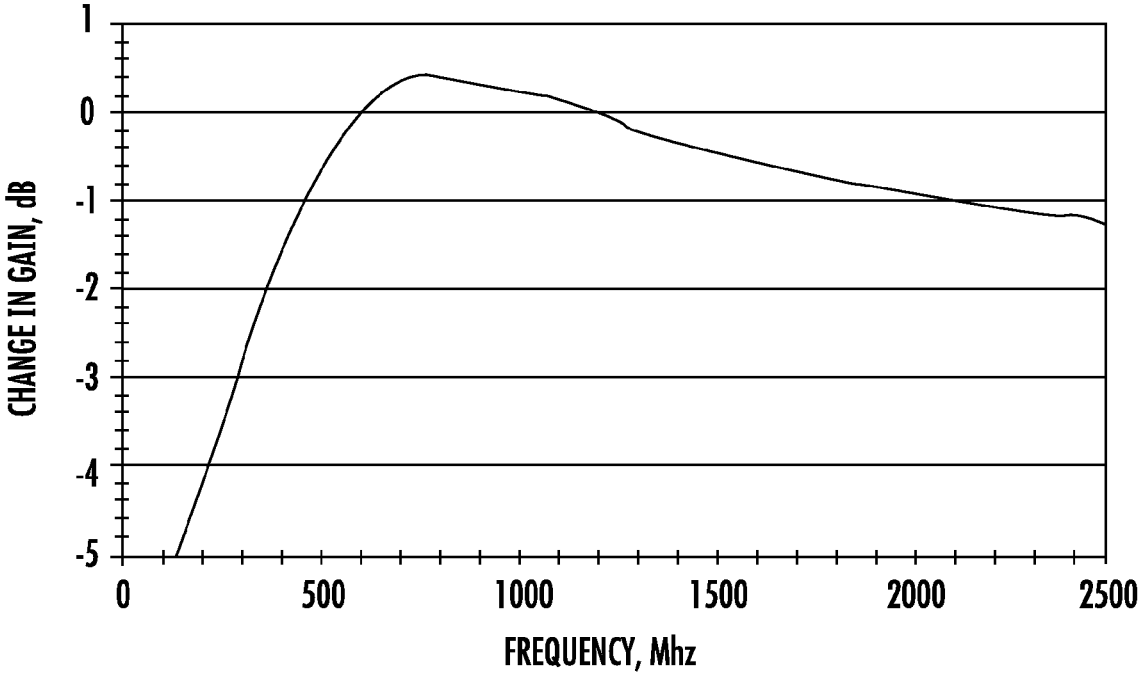
FIG. 5 is a plot of the gain of the conical monopole antenna of FIG. 1 relative a conventional conical monopole antenna.

FIG. 5 is a plot comparing the difference in gain of the conical monopole antenna 10 of FIG. 1 to a conventional conical monopole antenna. That is, FIG. 5 plots the amplitude of same antenna with and without the folded termination provided by fold conductor 20 and a 50 ohm resistor as impedance element 21. The units are in decibels rather not decibels with respect to isotropic, as the reference was the conventional conical monopole without the resistor. The measurement was taken in the horizontal plane. Referring to FIG. 5, when the 50 ohm resistor folded termination of impedance element 21 was implemented there was a gain increase of 0.4 dB at 800 MHz and a gain loss of 1.2 dB at 2500 MHz. Thus, the gain trade is readily seen.

Figure 6:
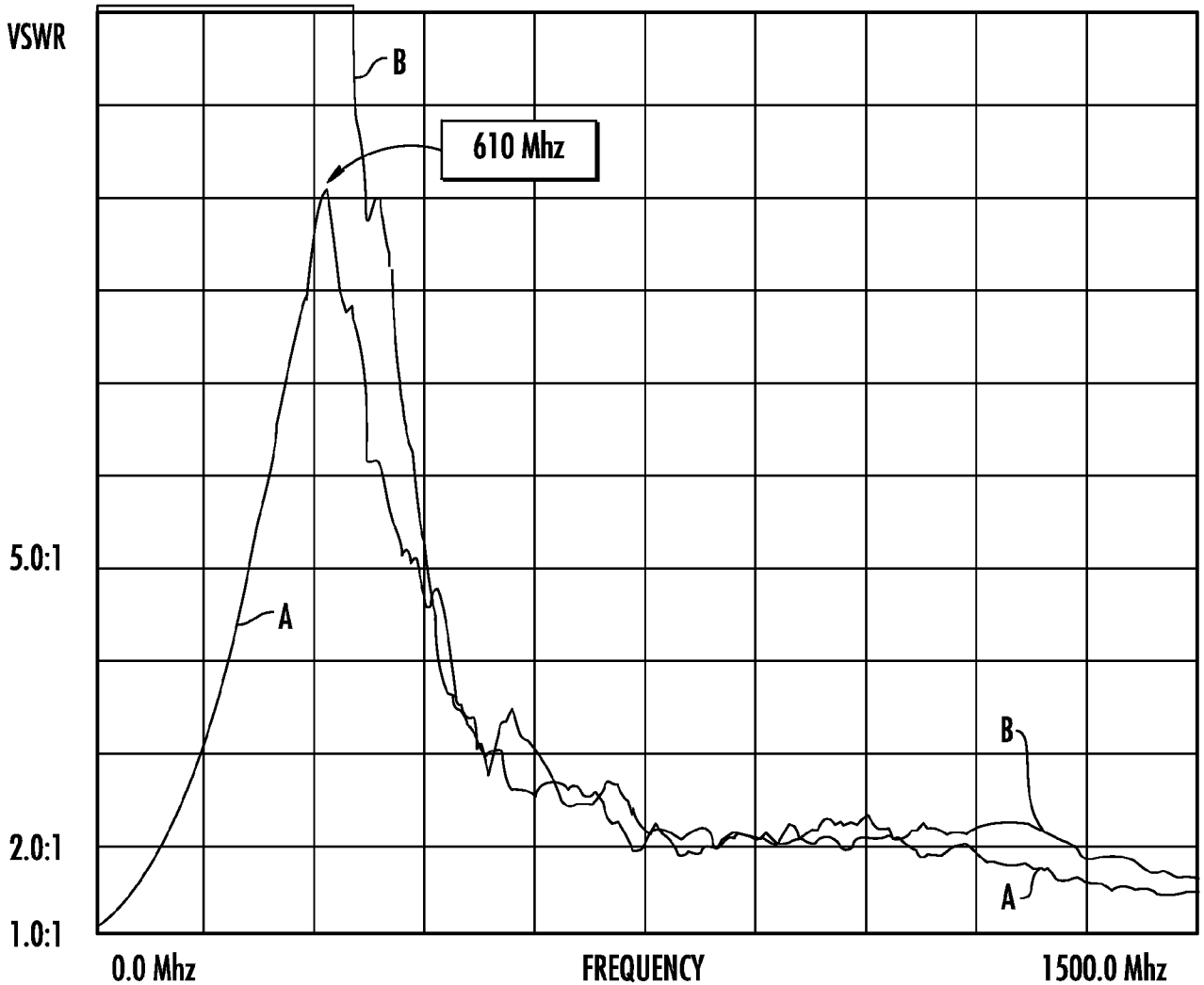
FIG. 6 is a plot of the measured VSWR of the conical monopole of FIG. 1 compared to a conventional conical monopole antenna.

FIG. 6 is a plot of the measured VSWR of the present invention and for a conventional conical monopole antenna. That is, FIG. 6 is plot of measured VSWR for the same antenna with and without the folded termination provided by fold conductor 20 and a 50 ohm resistor as impedance element 21. The source impedance of the radio transmitter used was 50 ohms, thus VSWR is for operation in a 50 ohm system. As can be seen, the resistive termination provided by resistive element 21 produced a large reduction in VSWR below normal cutoff frequencies. The present invention conical monopole antenna 10 may be a suitable load for transmitting equipment at most or all radio frequencies.

As those skilled in the art can appreciate, different trades between VSWR reduction below cutoff and gain reduction above cutoff are possible by varying the value of impedance element 21, which may also be an electrical network of capacitors, inductors, and resistors. The folded location of impedance element 21 is preferential as it allows for antenna termination, which is advantaged to e.g., an attenuator at the antenna feedpoint or edge termination with sheet resistive materials.

Fold conductor 20 can be connected directly to ground plane antenna element 16 without impedance element 21, or impedance element 21 can be made zero (0) ohms or nearly so. When this is done a folded conical half element is provided for conical monopoles and discone antennas, which may be useful for impedance matching, DC grounding, structural or other needs.

Referring to FIG. 1, design parameters for the present invention include the value of impedance element 21, cone flare angle α, cone height h, and ground plane antenna element 16 diameter. When antenna 10 is at great electrical size relative wavelength, e.g. at frequencies far above cutoff, the input impedance can be purely resistive and about equal to:

$$R_i = 60 \ln \cot \alpha/4$$

Where:

$R_i$=input impedance of conical monopole antenna 10

α=conical flare angle (FIG. 1)

Cone angle α is thus 94 degrees for 50 ohms at great electrical size. Large cone flare angles α in conical antenna element 12 (fat cones) have advantages of: low VSWR at antiresonance ($2F_c$), less pattern droop off the horizontal plane at higher frequencies, and lower driving point resistances. Tall slender cones are disadvantaged as they go in and out of resonance at octave intervals, and the elevation plane pattern lobes of conical monopole antennas can fire along the cones at large electrical size. The cone height and disc diameter are related to the lower cutoff frequency and the gain level, efficiency or VSWR specified for cutoff. For 50 percent radiation efficiency (−0.9 dBi gain) the cone height h was about $0.14\lambda_{air}$ and the disc diameter $0.098\lambda_{air}$.

The theory of operation of the present invention is similar to that of other conical monopole antennas, in that there is separation of charge inducing current flow along a radial rather than linear structure, e.g. along the surface of a cone rather than a line of wire and from a discontinuity at the cone apex. A cone and a disc provide the two conductors of a radial transmission line of uniform characteristic impedance which couples into free space by radiation at frequencies above cutoff. In the conical monopole antenna 10, impedance element 21 provides a termination parallel to the termination provided by radiation, to meet VSWR needs at those frequencies at which radiation is insufficient. The inclusion of inductor 29' chokes off the dissipative termination at high frequencies where it is unnecessary but permits it at low frequencies where the radiation termination is insufficient. Thus the frequency response impedance element 21 is preferentially the reciprocal of that provided by radiation.

A method aspect of the invention is directed to making a conical monopole antenna 10 including providing a conical antenna element 12 having an apex 14 and a base 15, coupling a conductive base member 18 across the base of the conical antenna element 12, and positioning a ground plane antenna element 16, such as a disc antenna element, adjacent the apex 14 of the conical antenna element 12. The method includes coupling a fold conductor 20 between the conductive base member 18 and the ground plane antenna element 16, and coupling an antenna feed structure 22 to the ground plane 16 and conical antenna element 12.

Coupling the antenna feed structure 22 may include coupling a first electrical conductor 24 to the conical antenna element 12, and coupling a second electrical conductor 26 to the ground plane antenna element 16. Coupling the fold conductor 20 may comprise coupling at least one impedance element 21, such as a resistor or inductor, between the conductive base member 18 and the ground plane antenna element 16. The method may include forming an opening 17 in the conical antenna element 12 adjacent the apex 14, and then coupling the fold conductor 20 may include extending the fold conductor through the opening 14 in the conical antenna element 12. The conical antenna element 12 defines an interior space 13, and extending the fold conductor 20 may include extending the fold conductor through the interior space 13 and through the opening 17 adjacent the apex 14 of the conical antenna element 12.

Although the present invention conical monopole antenna 10 is depicted in FIG. 1 with the mouth of conical element 12 upwards, conical monopole antenna 10 can of course be inverted and operated with the mouth of conical element 10 facing downwards. The discone antenna and conical monopole antennas are primarily inversions of one another, as can be apparent to those skilled in the art.

Figure 7:
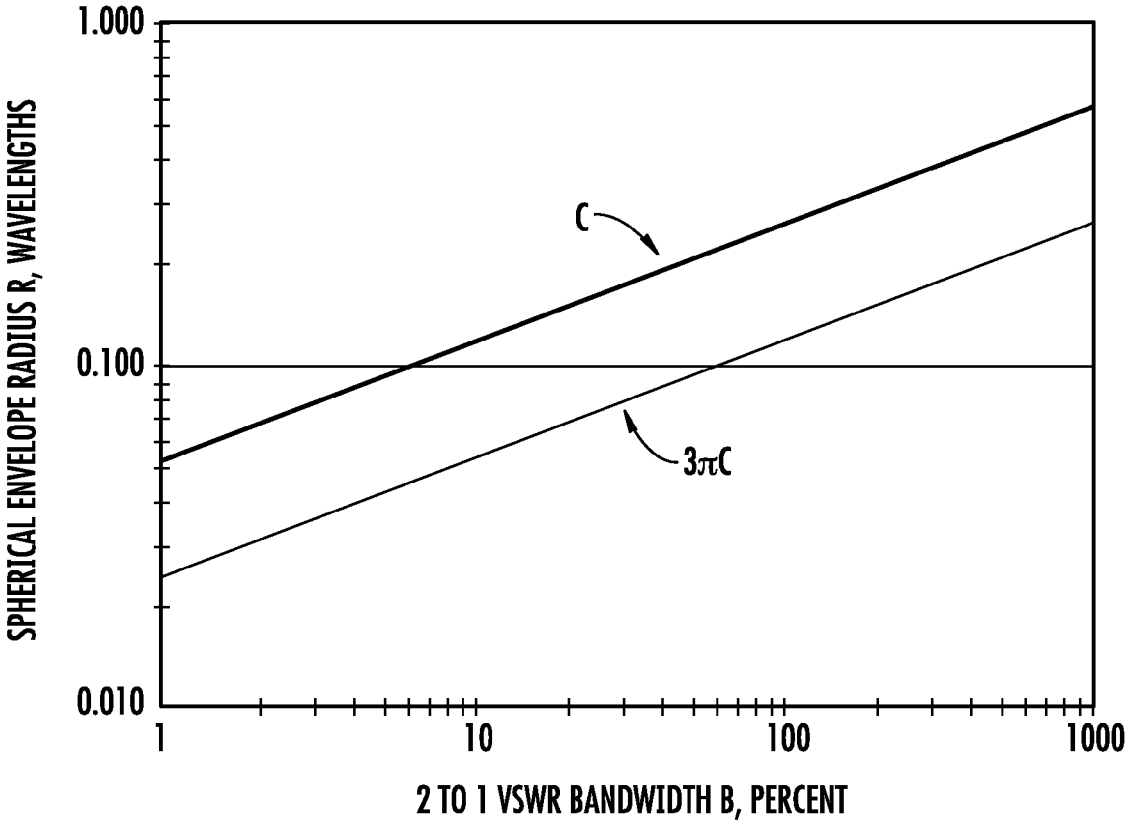
FIG. 7 is a plot of a size-bandwidth limitation common to antennas.

FIG. 7 is a plot of a size bandwidth limitation common to antennas, scaled here for 2:1 VSWR. This relation is sometimes attributed to Chu as "Chu's Limit" (again, Chu, "Physical Limitations of Omni-Directional Antennas"). The present invention is most directed to operation in the upper regions of the graph where VSWR bandwidth needs cannot be met due to fundamental limitations, e.g. limitations in wave expansion rate relative antenna size and structure. The invention can provide a resistive termination antenna for various (e.g. military) antenna needs, such as spread spectrum communications or instantaneous broadband jamming. Antennas may be required to provide low VSWR for high transmit powers at most frequencies, and to do at small sizes which are beyond the fundamental limitation in 100 percent efficiency instantaneous gain bandwidth: in such cases resistive loading is a must. In FIG. 7, curve C is for single tuning and given by $r/\lambda=^{1/3}\sqrt{[B/70.7(100\%)]}$, and curve 3πC is for infinite order multiple tuning and given by $r/\lambda=^{1/3}\sqrt{[B/3\pi 70.7(100\%)]}$, where B is fractional bandwidth and r is the radius of an analysis sphere enclosing the antenna. Both curves are for 100 percent antenna radiation efficiency.

The features as described above, may provide an electrically small communication antenna with broad voltage standing wave ratio (VSWR) bandwidth at most frequencies. In addition, many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A conical monopole antenna comprising:
- a conical antenna element having an apex and a base;
- a conductive base member coupled across the base of the conical antenna element;
- a ground plane antenna element adjacent the apex of the conical antenna element;
- a fold conductor coupled between the conductive base member and the ground plane antenna element; and
- an antenna feed structure coupled to the ground plane and conical antenna elements.

2. The conical monopole antenna according to claim 1 wherein the antenna feed structure includes:
- a first electrical conductor coupled to the conical antenna element; and
- a second electrical conductor coupled to the ground plane antenna element.

3. The conical monopole antenna according to claim 1 wherein the fold conductor comprises at least one impedance element.

4. The conical monopole antenna according to claim 3 wherein the at least one impedance element comprises at least one of a resistive element and an inductive element.

5. The conical monopole antenna according to claim 1 wherein the conical antenna element includes an opening adjacent the apex; and wherein the fold conductor extends through the opening in the conical antenna element.

6. The conical monopole antenna according to claim 5 wherein the conical antenna element defines an interior space, and the fold conductor extends in the interior space between the conductive base member and through the opening adjacent the apex of the conical antenna element.

7. The conical monopole antenna according to claim 1 wherein at least one of the conical antenna element, the conductive base member and the ground plane antenna element comprises a continuous conductive layer.

8. The conical monopole antenna according to claim 1 wherein at least one of the conical antenna element, the conductive base member and the ground plane antenna element comprises a wire structure.

9. A conical monopole antenna comprising:
- a conical antenna element having an apex and a base;
- a conductive base member coupled across the base of the conical antenna element;
- a disc antenna element adjacent the apex of the conical antenna element;

a fold conductor coupled between the conductive base member and the disc antenna element; and an antenna feed structure coupled to the disc and conical antenna elements including a first electrical conductor coupled to the conical antenna element, and a second electrical conductor coupled to the disc antenna element.

10. The conical monopole antenna according to claim 9 wherein the fold conductor comprises at least one impedance element.

11. The conical monopole antenna according to claim 10 wherein the at least one impedance element comprises at least one of a resistive element and an inductive element.

12. The conical monopole antenna according to claim 9 wherein the conical antenna element includes an opening adjacent the apex; and wherein the fold conductor extends through the opening in the conical antenna element.

13. The conical monopole antenna according to claim 12 wherein the conical antenna element defines an interior space, and the fold conductor extends in the interior space between the conductive base member and through the opening adjacent the apex of the conical antenna element.

14. The conical monopole antenna according to claim 9 wherein first conductor is connected to the conical antenna element at the apex thereof.

15. The conical monopole antenna according to claim 9 wherein first conductor and second conductor define a coaxial transmission feed.

16. The conical monopole antenna according to claim 9 wherein at least one of the conical antenna element, the conductive base member and the disc antenna element comprises a continuous conductive layer.

17. The conical monopole antenna according to claim 9 wherein at least one of the conical antenna element, the conductive base member and the disc antenna element comprises a wire structure.

18. A method of making a conical monopole antenna comprising:

providing a conical antenna element having an apex and a base;

coupling a conductive base member across the base of the conical antenna element;

positioning a ground plane antenna element adjacent the apex of the conical antenna element;

coupling a fold conductor between the conductive base member and the ground plane antenna element; and coupling an antenna feed structure to the ground plane and conical antenna elements.

19. The method according to claim 18 wherein coupling the antenna feed structure includes:

coupling a first electrical conductor to the conical antenna element; and coupling a second electrical conductor to the ground plane antenna element.

20. The method according to claim 18 wherein coupling the fold conductor comprises coupling at least one impedance element between the conductive base member and the ground plane antenna element.

21. The method according to claim 20 wherein the at least one impedance element comprises at least one of a resistive element and an inductive element.

22. The method according to claim 18 further comprising forming an opening in the conical antenna element adjacent the apex; and wherein coupling the fold conductor includes extending the fold conductor through the opening in the conical antenna element.

23. The method according to claim 22 wherein the conical antenna element defines an interior space; and wherein extending the fold conductor includes extending the fold conductor through the interior space and through the opening adjacent the apex of the conical antenna element.

24. The method according to claim 18 wherein at least one of the conical antenna element, the conductive base member and the ground plane antenna element are formed as a continuous conductive layer.

25. The method according to claim 18 wherein at least one of the conical antenna element, the conductive base member and the ground plane antenna element are formed as a wire structure.

* * * * *